United States Patent [19]

Kamikura et al.

[11] 4,079,601

[45] Mar. 21, 1978

[54] CONTROL DEVICE IN A KNITTING MACHINE

[75] Inventors: Shigeo Kamikura; Mitsuhito Koike; Kensuke Uemura, all of Kodaira, Japan

[73] Assignee: Silver Seiko Ltd., Tokyo, Japan

[21] Appl. No.: 803,884

[22] Filed: Jun. 6, 1977

[30] Foreign Application Priority Data

Jun. 4, 1976 Japan ..... 51-64466

[51] Int. Cl.[2] ..... D04B 7/00

[52] U.S. Cl. ..... 66/75.2; 66/154 A

[58] Field of Search ..... 66/75.2, 154 A; 340/172.5; 235/151.11

[56] References Cited

U.S. PATENT DOCUMENTS

| | | | |
|---|---|---|---|
| 3,035,426 | 3/1962 | MacQueen | 66/75.2 |
| 3,885,405 | 5/1975 | Manfred | 66/154 A |
| 3,983,718 | 10/1976 | Kahan et al. | 66/75.2 |
| 3,991,592 | 11/1976 | Kahan et al. | 66/75.2 |
| 4,006,611 | 2/1977 | Kahan et al. | 66/75.2 |
| 4,015,445 | 4/1977 | Kahan et al. | 66/75.2 |
| 4,036,035 | 7/1977 | Kahan et al. | 66/75.2 |
| 4,040,277 | 8/1977 | Kahan et al. | 66/154 A |

*Primary Examiner*—Ronald Feldbaum

*Attorney, Agent, or Firm*—Lane, Aitken, Dunner & Ziems

[57] ABSTRACT

An input device for providing signals for controlling a knitting machine. The device includes a mechanical information storage means and a switch means responsive to the contents of the storage means to provide a signal corresponding to the stored information. The storage means is disposed for operation either manually by a machine operator or electromechanically in response to instructions provided by other components of the machine. The device is incorporated in a program reading apparatus to specify feeding direction of the program carrier on the knitting machine.

7 Claims, 9 Drawing Figures

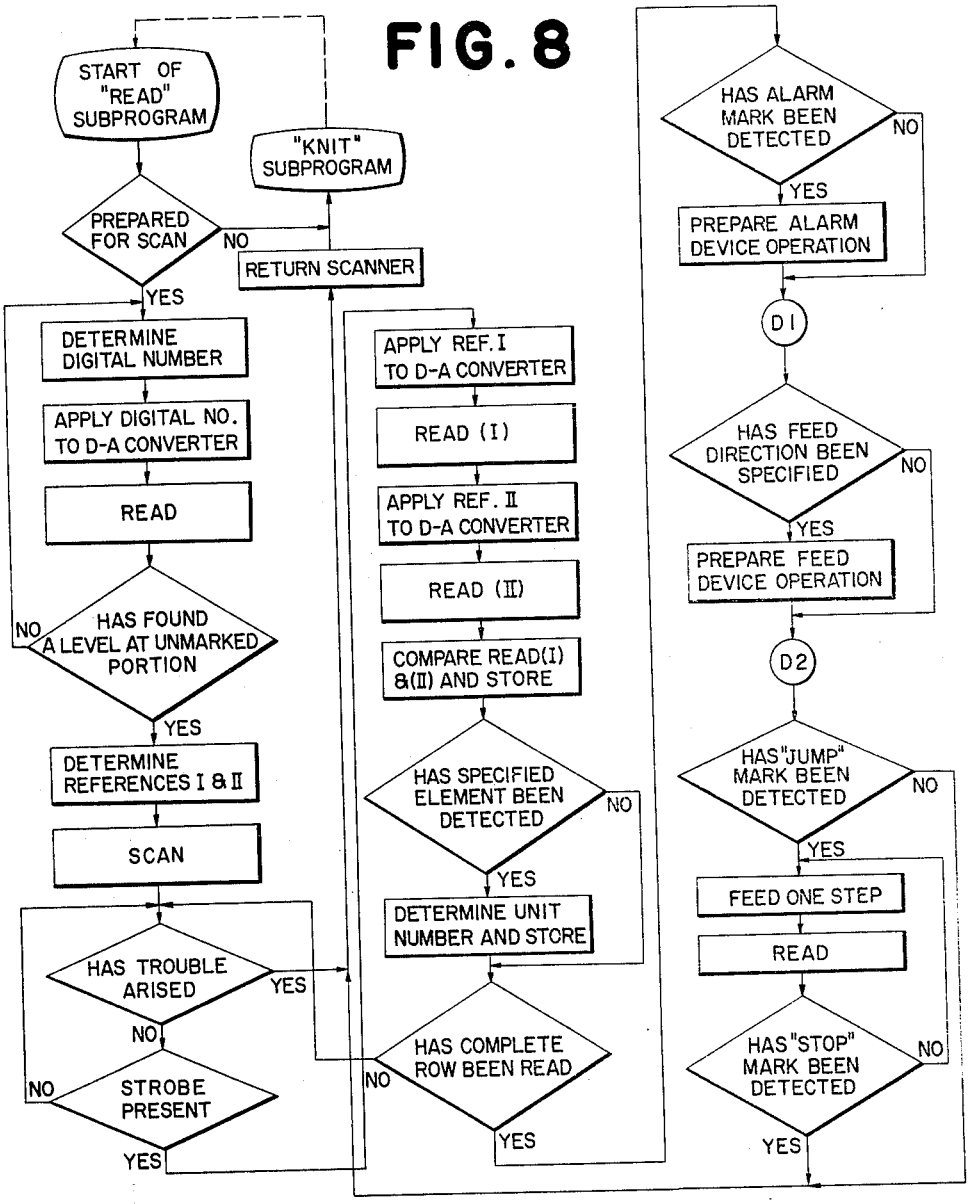
FIG. 8
START OF "READ" SUBPROGRAM
"KNIT" SUBPROGRAM
PREPARED FOR SCAN
NO
RETURN SCANNER
YES
DETERMINE DIGITAL NUMBER
APPLY DIGITAL NO. TO D-A CONVERTER
READ
HAS FOUND A LEVEL AT UNMARKED PORTION
NO
YES
DETERMINE REFERENCES I & II
SCAN
HAS TROUBLE ARISED
YES
NO
STROBE PRESENT
NO
YES
APPLY REF. I TO D-A CONVERTER
READ (I)
APPLY REF. II TO D-A CONVERTER
READ (II)
COMPARE READ(I) &(II) AND STORE
HAS SPECIFIED ELEMENT BEEN DETECTED
NO
YES
DETERMINE UNIT NUMBER AND STORE
HAS COMPLETE ROW BEEN READ
NO
YES
HAS ALARM MARK BEEN DETECTED
NO
YES
PREPARE ALARM DEVICE OPERATION
D1
HAS FEED DIRECTION BEEN SPECIFIED
NO
YES
PREPARE FEED DEVICE OPERATION
D2
HAS "JUMP" MARK BEEN DETECTED
NO
YES
FEED ONE STEP
READ
HAS "STOP" MARK BEEN DETECTED
NO
YES

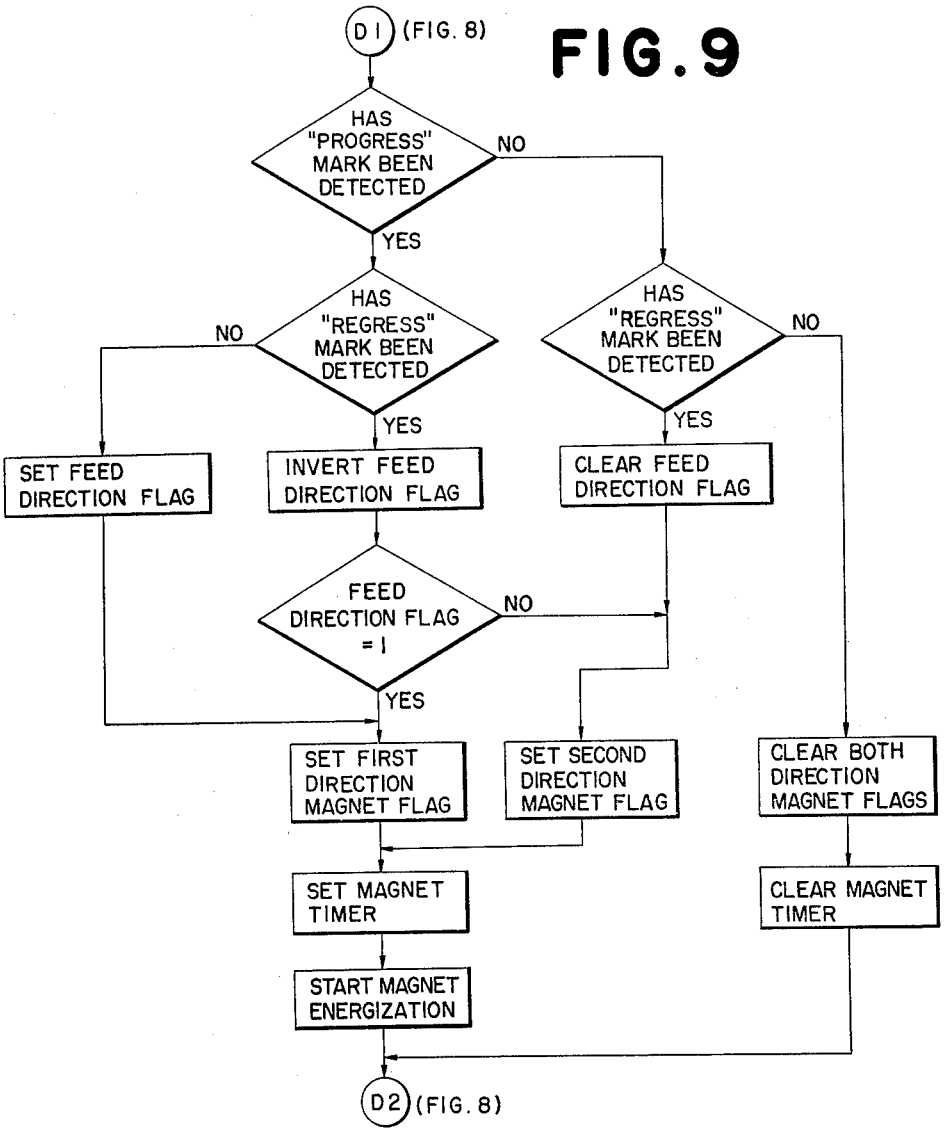
D1 (FIG. 8)
FIG. 9
HAS "PROGRESS" MARK BEEN DETECTED
NO
YES
HAS "REGRESS" MARK BEEN DETECTED
NO
YES
HAS "REGRESS" MARK BEEN DETECTED
NO
YES
SET FEED DIRECTION FLAG
INVERT FEED DIRECTION FLAG
CLEAR FEED DIRECTION FLAG
FEED DIRECTION FLAG = 1
NO
YES
SET FIRST DIRECTION MAGNET FLAG
SET SECOND DIRECTION MAGNET FLAG
CLEAR BOTH DIRECTION MAGNET FLAGS
SET MAGNET TIMER
CLEAR MAGNET TIMER
START MAGNET ENERGIZATION
D2 (FIG. 8)

CONTROL DEVICE IN A KNITTING MACHINE

BACKGROUND OF THE INVENTION

This invention relates to a knitting machine, and more particularly to a device for providing an electric signal representative of instructions for control of a component of a knitting machine.

In an electronically controlled knitting machine having a program reading device for reading design instructions on a program carrier or design paper, the for incrementally feeding the program carrier is preferably operable to feed the carrier alternatively in one or the other direction in response to reading of a particular instruction on the program carrier. The appropriate direction is visually indicated by a suitable means such as a display device. Such a feeding mechanism is disclosed in U.S. pat. application Ser. No. 737,433, titled "Knitting Machine Coupled with the Program Reading Device", filed on Nov. 1, 1976. Such a feeding mechanism may, for example, also be provided with input devices in the form of manually depressible keys, each operable to provide an electric signal to specify the feeding direction of the program carrier independent of the particular instruction on the program carrier. Conventional feeding mechanisms such as disclosed in the U.S. Pat. application Ser. No. 737,433 do not, however, include provisions to prevent loss of the stored information, for example, due to accidental or arbitrary interruption of the electrical power supply. Because of this, stored information pertaining to the feeding direction of the program carrier may be lost so that the program carrier may be fed in the improper direction after power is resumed. Thus, an erasable, nonvolatile, inexpensive information storage means is desired for this application.

SUMMARY OF THE INVENTION

Accordingly, a principal object of the present invention is to provide in a knitting machine an input device for providing an electric signal for control of a component of the machine such as a feeding mechanism of a program reading apparatus, which device is operable both manually and electromechanically to specify the electric signal and has an erasable, nonvolatile, inexpensive information storage means incorporated therein.

Another object of the invention is to provide in a program reading device for use with a knitting machine a feed mechanism operable to specify feeding direction of a program carrier by means of a mechanical storage element which is disposed for manual operation as well as for operation in response to reading a particular instruction on the program carrier.

The according to the present invention, for providing an electric signal representative of an instruction for control of a component of a knitting machine includes a support member, a manually operable shiftable member supported on the support member for shifting movement between a pair of positions, electromagnetic means alternatively energizable to shift the shiftable member from one to the other of said positions or vice versa, a drive circuit for energization of the electromagnetic means, and a switch disposed to be responsive to the position of the shiftable member to provide a corresponding output signal.

Further features and advantages of the present invention will be apparent from the following description of the preferred embodiments with reference to the accompanying drawings.

BRIEF DESCRIPTION OF THE DRAWINGS

FIG. 8 is a flow diagram according to the device of the invention; and

FIG. 9 is a flow diagram showing part of the flow of FIG. 8 more in detail.

DESCRIPTION OF THE PREFERRED EMBODIMENT

Figure 1:
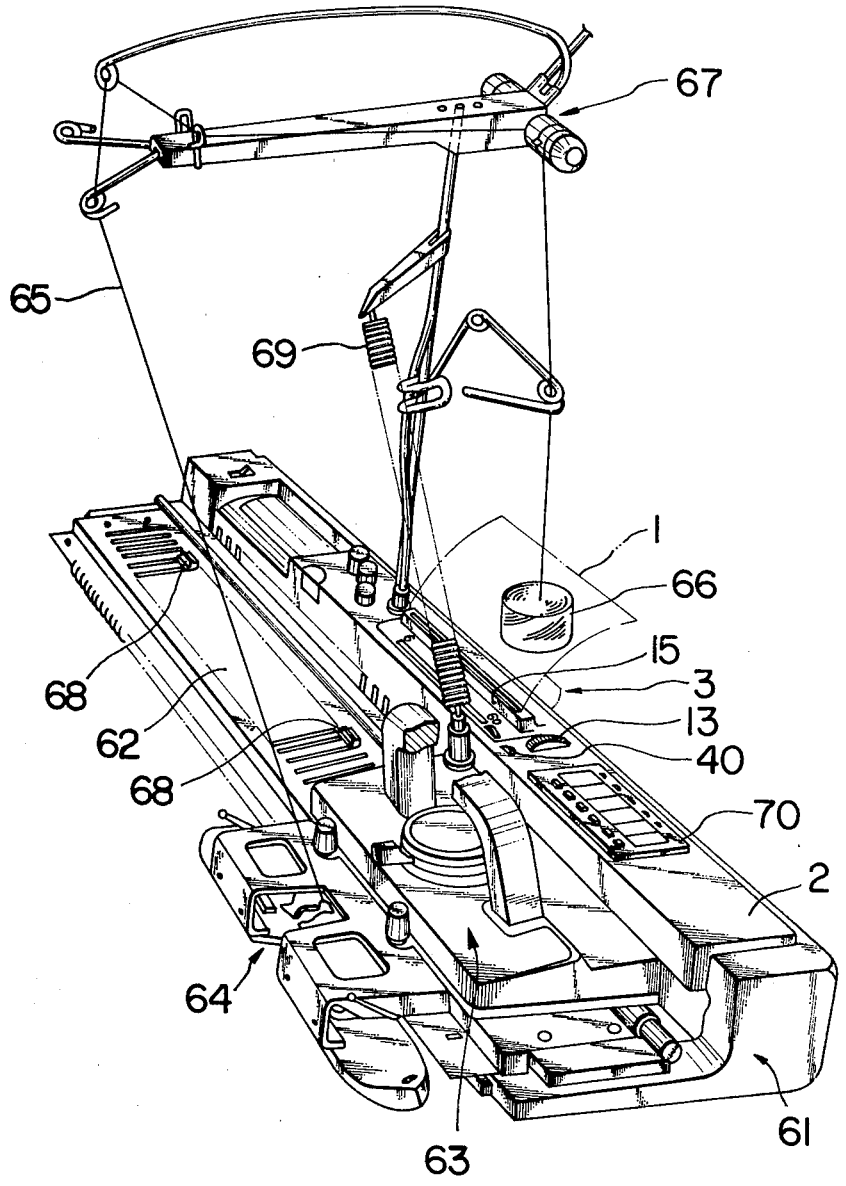
FIG. 1 is a perspective view of a hand operated knitting machine according to the invention illustrating generally the setting of the invention.

The knitting machine in FIG. 1 comprises a machine body 61 having thereon a needle bed 62. A plurality of movable knitting needles are mounted in the needle bed 62 in a side by side relation. A manually operable carriage 63 is slidably mounted on the needle bed 62 for operation of the knitting needles. The carriage 63 is provided with a yarn feeder 64 for laying or feeding a knitting yarn or yarns 65 onto the knitting needles during knitting operation. The knitting yarns 65 are supplied from yarn supplies 66 through a conventional takeup device 67 removably mounted on the machine body 61 and having takeup springs.

The carriage 63 is provided with a pair of needle selecting means (not shown) each of which comprises an electromechanical actuator means operable by a common drive circuit means for selectively operating the knitting needles. The carriage 63 is further provided with means for detecting the movement of the carriage relative to the needle bed. The detecting means includes for example, a carriage timing pulse generator, a carriage running direction detecting switch mechanism, etc., and a switch mechanism cooperating with a pair of actuator members 68. The positions selected by the operator for the actuator members 68 on the needle bed 62 defines a range in which the needle selection operation is to be effected by the needle selecting means as disclosed in U.S. patent application Ser. No. 737,433.

The detecting means and electromechanical actuators are electrically connected by means of a flexible multiwired cable 69 to the common drive circuit means which is provided under a cover 2 mounted on the machine body 61. The cover 2 has thereon an integral control board 70 provided with several manually operable members in the form of keys or push buttons as input means to the circuit means and with corresponding display devices as output means from the circuit means.

The machine body 61 is provided with a reading device generally designated by 3. The reading device is adapted to read the program or patterning instructions recorded on a program carrier 1 and to provide electric signals representative of the patterning instructions to the drive circuit means. The drive circuit means in turn provides drive signals to the electromechanical actuators in response to movement of the carriage 63 for selective energization for needle selection in correspondence with the signals provided by the reading device 3.

Figure 2:
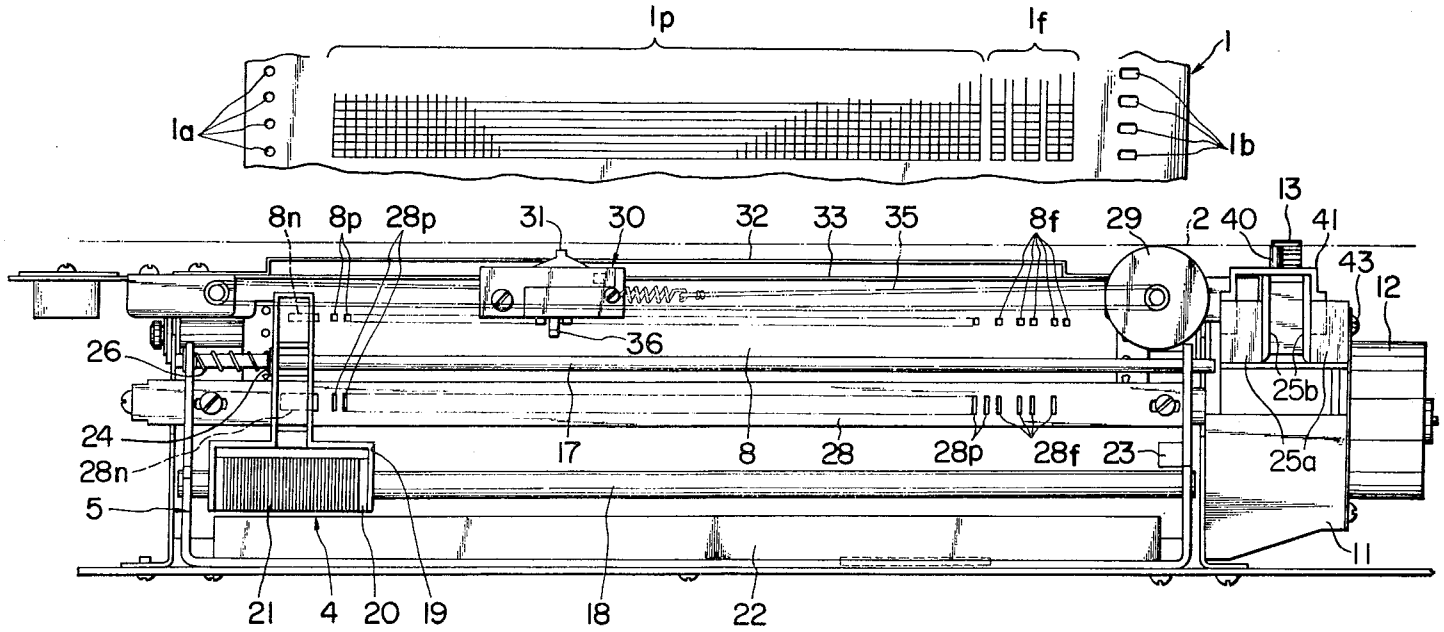
FIG. 2 is an elevational view showing in detail a reading device and program carrier or card according to the invention.
Figure 3:
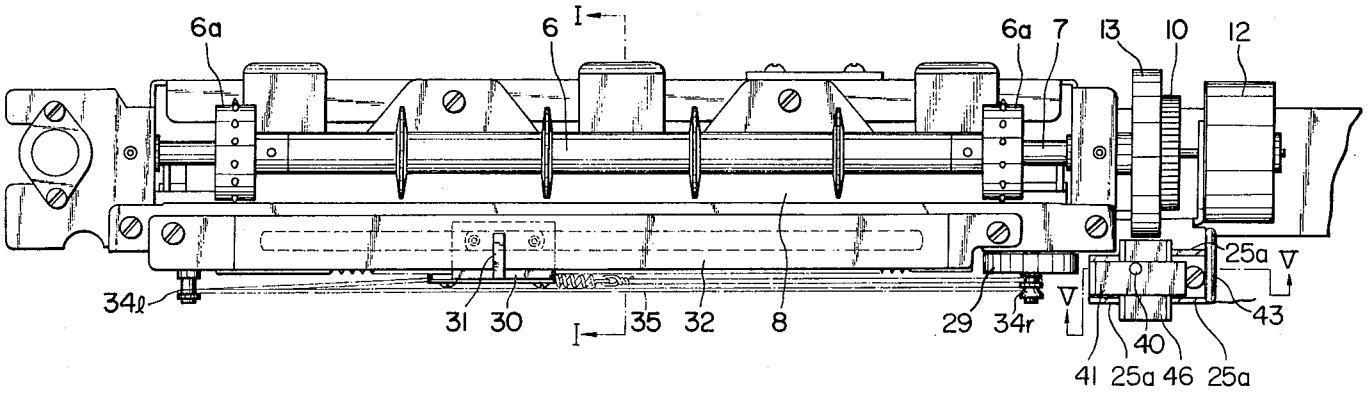
FIG. 3 is a plan view of the reading device of FIG. 2.

Referring to FIGS. 2–5, the reading device 3 is mounted on the machine body 61, including a frame 5 (actually comprising several elements) disposed under the cover 2. A shaft 7 having a feed roller 6 affixed thereto which includes a pair of sprocket wheels 6*a* for feeding the program card 1 in one or the other direction in cooperation with a pair of rows of perforations 1*a* and 1*b* formed in the card 1 is rotatably mounted in the frame 5. As shown in FIG. 3, four disks 6*b* are also provided on the feed roller 6 between the sprockets 6*a* for holding the program card 1 in a semi-cylindrical state.

Figure 4:
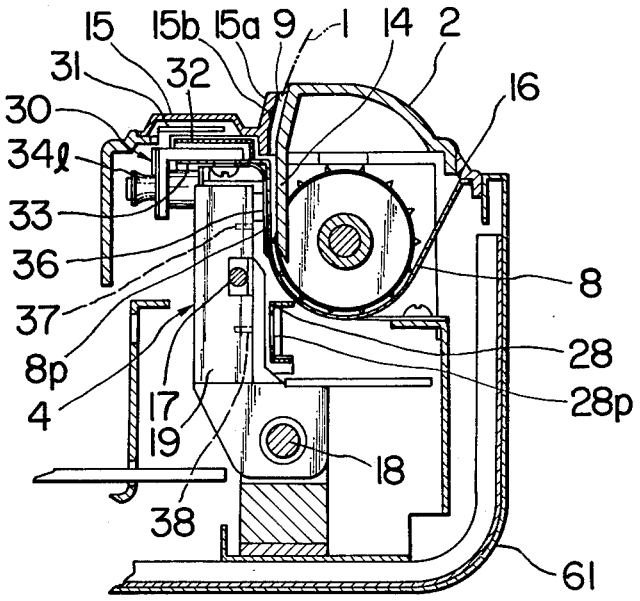
FIG. 4 is a sectional view showing additional construction details for the reading device.
Figure 5:
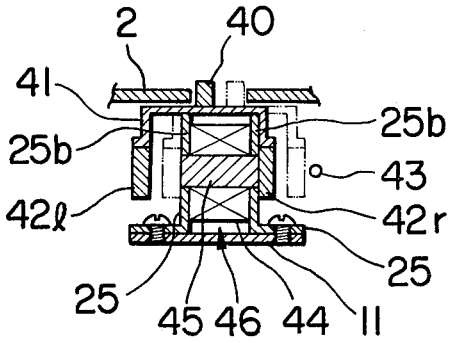
FIG. 5 is a sectional view of a new input device incorporated in the reading device taken along line V — V of FIG. 3.

A guide plate 8 in FIG. 4 having a nearly U shaped cross-section is mounted on the machine body for allowing contact of the program card 1 with the feed roller 6 for guiding the program card 1 from an elongated front opening or entrance slot 9 defined by the cover 2 and an upper plate 15 mounted on the cover 2 to another elongated rear opening or exit slot 16 formed between the cover 2 and the machine body 61 while the program card 1 passes over a scanning line of a scanning sensor 37 and further passes through the under face of the feed roller 6 along the lower circular portions of the disks 6*b* of the feed roller 6, or vice versa. The cover 2 is provided with five vertical hanging portions 14 in FIG. 4 between each sprocket wheel 6*a* and an adjacent disk 6*b* and also between the adjacent disks 6*b* for holding the card 1 inserted from the entrance slot 9 against the rear (right hand side in FIG. 4) face thereof to support it in a flattened state along the scanning line. The upper plate 15 is provided in the rear (right hand side in FIG. 4) side thereof with an upright portion 15*a* extending alongside the entrance slot 9. The upper plate 15 is made of a transparent material such as a transparent plastic material to allow direct observation of the program card 1 inserted from the entrance 9 through the upright portion 15*a* of the upper plate 15. A colored reference line 15*b* in FIG. 4 is provided on the upright portion 15*a* for appropriate positioning of the program card 1.

The feed roller 6 is adapted to be incrementally rotated in one or the other direction by means of a bidirectional stepping motor 12 cooperating through a gearing connection comprising a gear 10 and another gear (not shown) which are mounted on the shaft 7 of the feed roller 6 and the output shaft of the stepping motor 12, respectively, and the stepping motor 12 is mounted on a frame member 11 of the frame 5.

A thumb wheel 13 is exposed to the exterior of the machine through a window of the cover 2. Wheel 13 is mounted on the shaft 7 of the feed roller 6 to permit the manual operator to manually incrementally feed the card 1.

Input device is preferably provided on the reading device to be operable manually by the machine operator or in accordance with an instruction on the program carrier specifying the rotational direction of the bidirectional stepping motor controlling the feeding direction of the program carrier on the feed roller. In the embodiment shown in FIGS. 2, 3 and 5, the input device comprises a shiftable member 41 disposed shiftably between a pair of positions, i.e. the left and right positions. The shiftable member 41 includes a pin 40 fixed thereon and extending beyond the top of the cover 2 through an elongated hole formed therein so as to be manually operable by a machine operator to shift the member 41 between said positions. The shiftable member 41 has a pair of downwardly extending legs disposed in a spaced relation, each having a piece of permanent magnet 42 adherently attached thereto with the magnetic poles disposed opposite to each other as diagrammatically illustrated in FIG. 6.

Figure 6:
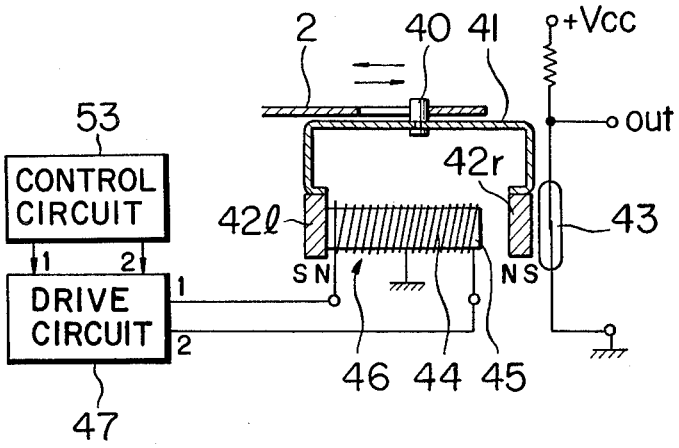
FIG. 6 is a diagrammatic view of the input device illustrated in FIG. 5 showing the operation of the input device.

A switch 43 is provided at the full right position for the shiftable member 41 and is of a type responsive to a magnetic field such as a lead switch or a Hall element switch. The switch 43 is positioned for operation by one of the magnets 42 to detect the position of the shiftable member 41 such that it is switched ON when the shiftable member 41 is in the right position and OFF when same is in the left position, respectively. The switch 43 is electrically connected between ground and (through a dropping resistor) to positive voltage supply Vcc, with switch output taken on the high voltage side of the switch 43, as shown in FIG. 6. The switch output is connected to the circuit means which controls the direction of rotation the stepping motor 12.

The switch 43 is adherently attached to one of a pair of brackets 25 which in turn are mounted on the top of an upper extension of the frame member 11. Each bracket 25 is provided with a pair of upstanding wings 25*a* defining a channel for receiving therein the legs of the shiftable member 41 to guide member 41 for shifting movement. Each bracket 25 is further provided with an upstanding wall 25*b* for supporting an electromagnet 46 including a core 45 supported on the walls 25*b* of the brackets 25 and a coil 44 wound on said core 45. The core 45 is disposed between and in alignment with the pair of permanent magnets 43, as particularly shown in FIG. 5, so that energization of the electromagnet 46 causes the shiftable member 41 to be shifted by the magnetic forces between the electromagnet 46 and the permanent magnets 42. It will be clearly understood that the direction of such shift movement of the member 41 depends upon the direction of the current flow through the coil 44 of the electromagnet 46.

In the embodiment as particularly shown in FIG. 6, however, the coil 44 has a pair of independently energizable coil portions defined by the two terminals and the ground tap. The coil portions are adapted to be alternatively supplied with electric current at the terminals thereof by a drive circuit 47 so that the polarity of the electromagnet 46 and accordingly the direction of shift movement of the shiftable member 41 depend upon which coil portions are supplied with electric current. Thus, a current flow through one of the coil portions causes the shiftable member 41 to shift alternatively to the right or left position which is detected by the switch 43, as mentioned above.

The drive circuit 47 may conveniently consist of a pair of arrays of suitably connected transistors constituting a power amplifier and is connected to a control circuit 53 in the circuit means. The control circuit 53 includes therein a memory means for temporarily storing signals representing design and function instructions read out from the program carrier 1, including a pair of particular instructions for specifying the feeding direction of the program carrier 1, as hereinafter described. The control circuit 53 is conditioned by input signals from an input means generally illustrated by the block 58 in FIG. 7 to permit recall at an appropriate instant from the memory the signals representing particular instructions and provide to the drive circuit 47 a pulse for necessary energization of the electromagnet 46 in accordance with such recalled signals.

In operation, a row of design and function instructions is read out from the program carrier 1 each time the carriage 63 is traversed. When an instruction mark is detected for specifying the feeding direction as "progress" or "regress" during such reading, the electromagnet 46 is energized in correspondence with the instruction mark to shift the shiftable member 41 to the specified position, while, however, when no such instruction mark is detected, the electromagnet 46 is not energized so that the shiftable member 41 remains in the prior position. The member 41 is also manually shiftable. The position of the member 41 is detected by the switch 43 prior to every energization of the stepping motor 12 to feed the program carrier 1. This is accomplished each time the carriage 63 is traversed on the needle bed 62.

Because of this arrangement, the physical position of the pin 40 on the shiftable member 41 is indicative of the feeding direction of the program carrier 1. This provides a considerable advantage in that the feeding direction is automatically stored if electric power to the knitting machine is lost and so that knitting may be properly restarted from the suspended point when power is resumed.

The program card 1 in FIG. 2 together with the reading means is used to instruct or program the circuit means, which may includes a microcomputer means, to control the manner in which the fabric is knitted. As shown in FIG. 2, the card 1 includes, between a pair of rows of perforations 1*a* and 1*b*, mutually perpendicular lines which define a design area 1*b* of rectangles which extend in columns and rows. The rectangles in the design area 1*p* correspond to stitches and the columns and rows to wales and courses, respectively, which may be knitted in a fabric in accordance with instructions on the card. Preferably the width and height of each rectangle is such as to substantially correspond to the width and height of a typical stitch.

The card 1 further includes, between the design area 1*p* and the right-hand side row of perforations 1*b*, a function area 1f which involves one independent and two paired columns of rectangles aligned with the rows of rectangles in the design area 1*p*. The columns in the function area 1*f* are provided for operation of output elements of the circuit means, and the independent column has to do with action of an alarm device. A rectangle of the independent column may be selectively darkened so that the alarm device may operate at a desired time during knitting, such time being, for example, when a knitting yarn 65 is to be changed for another yarn different as in a color or the like.

The remaining pairs of columns in the function area 1f have to do with feeding of the program carrier 1. The first left pair of columns contains the feeding direction instructions. A rectangle of each column of the pair may be selectively darkened so that the carrier 1 may be fed reciprocatingly between the positions defined by such rectangles. Thus, pattern knitting using a program carrier such as program carrier 1 may provide for vertical mirror repeat imaging of a unit design defined vertically by the marks on the program carrier.

The second right pair of columns in the function area 1*f* provides special feeding instructions for the carrier 1. The left column of the pair has to do with successive feeding (jump) instructions for the carrier 1 and the right with stop instructions in connection with successive feeding. A rectangle of each column of the pair may be selectively darkened to specify successive feeding of the carrier 1 between the position defined by such rectangles. In a case in which the rectangles are aligned with the darkened rectangles of the first pair of columns, pattern knitting may provide for vertical repeat imaging of a unit design on a knitted fabric.

The reading device 3 further includes a scanning member 4 which is slidably mounted on a pair of upper and lower guide rods 17 and 18 mounted on the frame 5 in parallel with the shaft 7 of the feed roller 6.

A transverse slot provided in a running body 19 of the scanning member 4 is slidably met with the upper guide rod 17, while a bobbin 20 affixed to the running member 19 is slidably met with the lower guide rod 18. A coil 21 is wound around the bobbin 20. Disposed in a position below the lower guide rod 18 and fixedly mounted on the frame 5 in parallel with the guide rod 18, is an elongated permanent magnet 22 constituting a linear motor cooperative with the coil 21. Different magnetic poles are provided for the upper and lower portions of the permanent magnet 22 respectively, and the lower guide rod 18 and at least part of the frame 5 are preferably made of any magnetic material to form a desired magnetic path. During operation, the application of current to the coil 21 causes the scanning member 4 to be traversed along the length of the guide rods 17 and 18 in response to the direction of the current flowing through the coil 21.

The scanning member 4 is normally positioned at the left stroke end in the position shown in FIG. 2 and is moved from the left to the right stroke end and subsequently returned to the original left stroke end from the right in response to the directional movement of the carriage 63. The reciprocating movement of the scanning member 4 is typically accomplished in a continuous cycle without any dwelling.

A limit switch 23 is appropriately positioned relative to the right stroke end of the scanning member 4 and a stop 24 is attached to the upper guide rod 17 in a position corresponding to the left stroke end of the scanning member 4. The guide rod 17 is preferably movably mounted on the frame 5 so as to be movable a predetermined distance in the longitudinal direction relative to the frame 5, and to be urged to the right direction by a spring buffer 26 at the left end portion of the rod 17. During operation the spring 26 protects or relieves the scanning member 4 from shock at the left stroke end when the scanning member 4 comes into colliding contact with the stop 24 during return movement to the left.

A photoelectronical sensor 37 including a light emitting element and a photoelectrical transducer to convert the light reflected from the surface of the program card 1 to an electric signal is disposed at a right hand side portion of the scanning member 4 as shown in FIG. 4. The sensor 37, hereinafter referred to as the "scanning sensor" is adapted to scan the program card 1 along the predetermined scanning line.

In order to properly expose the program card 1 on the feed roller 6 to the scanning sensor 37, the card guide plate 8 is provided along the scanning line of the scanning sensor 37 with slits 8*p* which correspond to the columns in the design area 1*p* of the program card and also with slits 8*f* which correspond to the columns in the function area 1*f*. The slits 8*p* and 8*f* of FIG. 2 could also be formed as one or several elongated holes.

In order to enable the scanning sensor 37 to read an unmarked portion of the program carrier 1 at the start of a scan by the scanning member 4, the card guide plate 8 is formed with a further slit 8*n* which is disposed at the left of and in line with the row of slits 8*p* and 8*f* so that the scanning sensor 37 in the original position can read the blank or unmarked area specially provided at the left outside of the design area 8*p* on the program carrier 1.

A horizontally extending linear encoder 28 in the form of an elongated plate is mounted on the frame 5 in parallel with the guide rods 17 and 18 in a position below the scanning line in the rear (right as viewed in FIG. 4) side of the scanning member 4. The linear encoder 28 has slits 28*p* and 28*f* formed thereon corresponding, respectively, to the columns in the design area 1*p* and function area 1*f* on the program card 1. It is to be understood that the width of each of the slits 28*f* and 28*p* may be formed less than the width of the corresponding slits 8*f* and 8*p* provided in the card guide plate 8.

A similar photoelectronic sensor, including a sampling pulse generator 38 is attached in the scanning member 4 for photoelectronically reading the slits 28*p* and 28*f*. This sensor includes a light emitting element for irradiation of light onto the front face of the linear encoder 28 and a photoelectric transducer for converting the light reflected from the encoder to an electric signal. The sampling pulse generator 38 is adapted to produce pulses corresponding to the slits 28*p* and 28*f* as the scanning member 4 tranverses along a row of rectangles over the design and function areas 1*p* and 1*f* on the program card 1. The pulses thus obtained are used to sample the output of the scanning sensor 37 to produce corresponding signals representative of the design or function instructions marked in the rectangles included in the corresponding row. Thus, the slits 28*p* and 28*f* of the linear encoder 28 function as the so-called "strobe marks", and the signals are temporarily stored in a memory in the circuit.

Marks in the design area 1*p* of the program card 1 define the pattern to be knitted. Marks in the function area 1f may also define a pattern to be knitted such as providing for vertical repeat imaging or a vertical mirror repeat imaging of a unit design. The boundaries for a unit design area to be repetitively reproduced in a fabric must be selected or specified by the machine operator, and the boundaries in the vertical or feeding direction of the program card 1 will be specified by selectively darkening rectangles in one or both of the pairs of the columns in the function area 1*f* while the boundaries in the horizontal direction will be specified by means of a size delineating means which will be described in detail.

Referring now to FIGS. 2–4, an extension 33 extending horizontally and adjacent to the upper plate 15 is formed in the front (left as viewed in FIG. 4) portion of the guide plate 8. Notches are formed in the extension 33 corresponding to the slits 8*p* and an elongated hole disposed in parallel with the scanning line in the intermediate position of the extension 33.

A movable defining member designated generally by the numeral 30 is slidably mounted on the extension 33, and includes a body comprising a horizontal portion and vertical portion. A spacer engaged in the elongated hole to guide the movable head 30 along the hole, and a metallic reflective plate 36 disposed in the opposite side of the extension 33 for restraining the vertical movement of the head 30, are fastened in a lamination by a set screw on the horizontal portion of the body. A hole is provided in the vertical portion of the body to provide for mounting a detent roller for engagement with a notched portion of the extension 33. The detent roller is urged against the notched portion of the extension 33 by a leaf spring fixed to the front of the vertical portion.

A manually operable thumb wheel 29 is rotatably mounted on the frame 5 in the vicinity of the right end of the extension 33 for moving the defining member 30 along the length of the knitting machine. The upper portion of the thumb wheel 29 is exposed to the exterior through a window opening formed in the cover 2. The thumb wheel 29 has a pulley 34*r* integrated therewith. A cord 35 connected to said defining member 30 is extended between the pulley 34*r* and another pulley 34*l* rotatably mounted on the frame 5 in the vicinity of the left end of the extension 33. The cord 35 has one end fixedly connected to the member 30 and the other end connected to one end of a takeup coil spring. The other end of the spring is connected to the member 30. In order to permit movement of the movable head 30 to the right or left direction as viewed in FIG. 2 or 3 as the wheel 29 is manually rotated, the cord 35 is wound in several rolls around the pulley 34*r* and the tension of the coil spring is chosen so that the spring provides sufficient friction between the pulley 34*r* and the cord 35 to move the defining member 30 in response to manual rotation of the wheel 29.

The reflective plate 36 mounted on the body of the defining member 30 has a vertical portion extending downwardly beyond the slits 8*p* on the guide plate 8 and is disposed adjacent to said guide plate 8. The surface of the vertical portion (the left hand side surface as viewed in FIG. 4) is formed as a mirror to enhance the reflection of the light. The vertical portion has a width sufficient to cover or shut one slit 8*p* on the card guide plate 8.

A scale 32 having graduations aligned with the columns in the design area 1*p* of the program card 1 and several numbers indicative of the numerals corresponding to the number of columns numbered from the leftmost column as viewed in FIG. 2 is disposed between the upper plate 15 and extension 33. The defining member 30 includes a pointer 31 integrated with the body for indicating the graduation on the scale 32. With this arrangement, the indicator including the pointer 31 and scale 32 indicates the column in the design area 1*p* on the program card 1 corresponding to the slit 8*p* on the guide plate 8 covered by the reflective plate 36.

The design column on the card 1 indicated by the indicator is used to specify the right hand boundary column while the left hand boundary column is always specified by the leftmost design column on the card 1. Accordingly, the size of the desired unit design in the horizontal direction is specified by the number of the columns included between the left and right hand boundary columns inclusive, the number being indicated by the indicator means as described above. As a result of this arrangement, the size of the unit design in the horizontal direction may be specified and selected by manual operation of the thumb wheel 29 by the machine operator.

As previously mentioned, the front face of the reflective plate 36 is formed as a mirror having a relatively high reflectivity factor for light as compared with either the front face of the guide plate 8 which is typically colored in black for minimizing reflection of light or the surface of the card 1. Due to this arrangement the output voltage from the scanning sensor 37 is rapidly raised, when the scanning sensor 37 comes to a position opposed to the reflective plate 36, to a level considerably higher than the output voltage otherwise resulting when reading a marked or unmarked instruction on the program carrier. A comparator means is provided for comparing the output of the scanning sensor 37 with an appropriate reference voltage to detect when the sensor 37 is in a position opposed to the reflective plate 36. The appropriate reference voltage may be readily determined by experiment and has a level intermediate between the aforementioned level and any other highest level when the sensor 37 reads other than the reflective plate 36.

Figure 7:
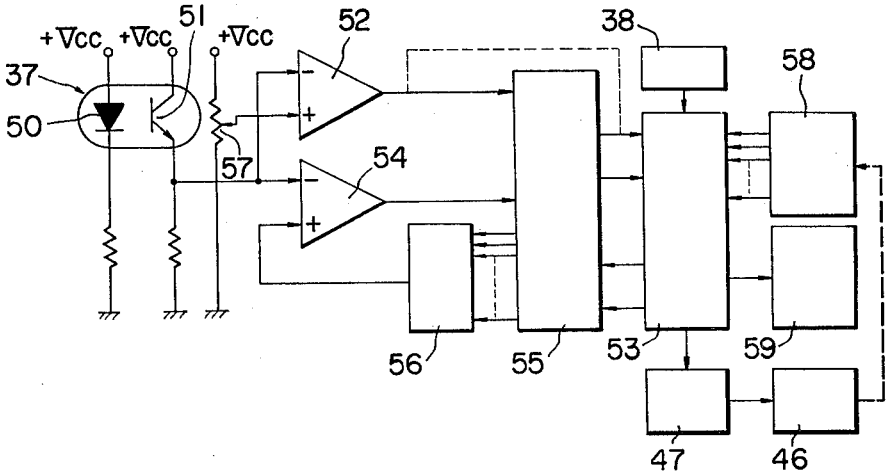
FIG. 7 is a partial schematic, partial block diagram of an electric circuit according to the device of the invention.

For this purpose an analog comparator 52 compares the output voltage from the photoelectric transducer 51 of the scanning sensor 37 with the reference voltage determined by experiment and provided by a variable resistor 57. The scanning sensor 37 as shown in FIG. 7 has a light emitting element 50 and a photoelectric transducer 51. The output of the comparator 52 is a binary signal which is normally a high voltage but which becomes a low voltage when the scanning sensor 37 detects the reflective plate 36.

The output of the sampling pulse generator 38 is connected to a similar comparator, the output of which is, in turn, connected to a control circuit 53. The output pulses of this comparator (which is included in the pulse generator 38 in FIG. 7) are sequentially counted by a counter provided in the circuit 53 from the start of a scan by the scanning member 4. The counter is typically cleared immediately prior to the start of a count.

The counting operation of the counter is suspended from counting when a low voltage as mentioned above is supplied from the comparator, and such counting value is stored in a memory included in the control circuit 53. Thus, a preset needle selecting unit number may be stored in the memory in the form of an electric digital signal by controlling the pointer 31 based on the graduations on the scale 32 by turning the thumb wheel 29 as mentioned above.

The control circuit 53 includes a memory for storing the binary signals derived from reading the knitting pattern, and the electric binary signals stored in memory may be repeatedly read out in order according to the number of bits corresponding to the counter values stored in the memory. Then as the carriage 63 traverses the needle bed, appropriate needle selection will be accomplished by a needle selecting device 59 including the previously described electromechanical actuators.

In FIG. 7, all the input devices other than the scanning sensor 37 and sampling pulse generator 38 are illustrated as being included in a block 58 wherein are provided as mentioned above, a carriage timing pulse generator, switch mechanisms for detecting the carriage running direction and needle selection range, the input means provided on the control board 70 on the cover 2 including the switch 43, and any other input means of the knitting mechine.

The circuit of FIG. 7 is also provided with a means for finally determining the binary "1" or "0" value of an electric signal corresponding to the presence or the absence of the markings. This result is achieved due to the fact that the reflectivity factor for light depends upon the type of marking material used for providing markings on the card 1 and the type of material constituting the card. For example, if conventional white paper is used for the card material, a ratio of the reflectivity factor of light in a blanking area to an area preprinted with black ink is approximately 3 through 7 to 1. Accordingly, the reflectivity factor of light in the marked area is considerably less than that in an unmarked or blanking area. On the other hand, when a transparent or translucent material obtained by mat-finishing (i.e. creating very slight unevenness by a mechanical or chemical process in one or both faces of a film) plastic film such as a polyestate resin film is used for the card material, the design area may be marked in black with a pencil by the operator. In this case, the ratio of the reflectivity factor of light of the blanking area to the black penciled area is approximately 1 to 2 through 4. Accordingly, the marked area has a considerably high reflectivity factor compared with the blanking area. It may be understood with the foregoing experimental data that the white paper has an inverse reflectivity relationship as compared to the film material with reference to the reflectivity factor of light. Nevertheless, the electric binary "1" or "0" signal must be determined depending on the presence or the absence of the markings.

To overcome this problem, the circuit in FIG. 7 is provided with another analog comparator 54, a digital to analog converter 56, and an operation circuit including a memory in logic circuit 55 for controlling the comparator 54 and converter 56. Operation of this circuit means will now be described.

A start signal for triggering the linear motor is initially applied from the control circuit 53 to the logic circuit 55 at the beginning of a scan by the scanning member 4. The operation circuit is adapted to control the converter 56 to detect the output voltage of the scanning sensor 37 at the beginning of a scan. As a result, a digital voltage signal is obtained corresponding to the sensor 37 output voltage corresponding to a reading of the blanking area on the program card 1. Subsequently, a value is added to and subtracted from the digital volume signal to obtain a first and a second reference digital voltage signal, respectively. The value added or subtracted corresponds to an appropriate voltage at the input of the comparator 44 which has been predetermined by experiment. Next, a scan of the program carrier 1 by the scanning member 4 is started. During the scan, the operation circuit provides an output for each strobe pulse applied from the pulse generator 38 through the control circuit. The operation circuit output is alternatively provided successively to the converter 56 to produce the first and then the second reference digital voltage signals for successive paired comparisons with the output of the scanning sensor 37. The results of the successive comparisons are then compared with each other in the operation circuit to obtain a final result in the form of a binary value "1" or "0" representing a design or function instruction in a rectangle on the program carrier 1 as read by the reading member 37. The resulting ones and zeros correspond to markings and lack of markings, respectively, on the program card 1. The effectiveness of the circuit depends upon the output of the sensor 37 being a value intermediate between the first and second reference voltages when reading an unmarked area, and upon the results of the first comparison being outside of the range between the two reference voltages, regardless of whether higher or lower than either such reference voltage when reading a marked area. The binary signals obtained as a result of the second comparison are individually stored in a memory means as instruction signals, each being representative of a design or function instruction. The stored instruction signals are thereafter recalled from memory as required.

Meanwhile, during a scan the column counter counts the strobe pulses (up to "64") corresponding to the total number of slits 28*p* and 28*f* when the scanning member 4 arrives at the right stroke end. The scanning member 4 is then immediately actuated to move leftwardly to return to its original starting position except when a marking for a jump or successive feed is detected. In such event, the scanning member 4 is stopped at the right stroke end such that the scanning sensor is then opposite to the rightmost column on the program carrier. The stepping motor 12 is then immediately energized to feed the program carrier 1. The feeding of the program carrier 1 continues until the scanning sensor 37 detects a marking in said rightmost "stop" column. At such time the scanning member 4 is caused to return to its original starting position. During the return stroke, the circuit 45 disregards any readings by the sensor 37.

If a marking is detected in the independent column of the function area 1*f* of the program carrier 1 during such scanning, the circuit means prepares to actuate an alarm device at the instant when the scanning member 4 arrives at the right stroke end. The alarm device may be operated at such instant or at any desired instant thereafter, for example, at the end of the return stroke of the scanning member 4.

If a marking is detected in either column of the first pair of columns during such scanning, the circuit means also preparest to initiate a control operation also at the instant the scanning member 4 arrives at the right stroke end. Such operation may be stopped either automatically by the circuit means after a predetermined interval of time or manually by means of a specially provided input means such as a stop button.

The operation of the reading device 3 as just described is effected continuously except when a needle selecting operation is required by the electromechanical needle selection mechanism on the carriage. For example, a scan is started at a suitable point in time when the carriage is positioned outside the range defined by a pair of actuator members 68 placed on the needle bed 2. Such a point in time may be, for example, at an instant when the carriage has just passed the actuator members 68 on the needle bed for given direction of carriage travel and is then outside the range defined by the actuator members 68.

In FIG. 7 the circuit means is illustrated as including two circuits, namely the control circuit 53 and the logic circuit 55. However, the two circuits may actually be implemented as a single chip of LSI constituting as a mini- or microcomputer having a stored program control and/or hardwired logic circuitry. In a preferred embodiment, the program control for such a computer implementation for control of the overall patterning mechanism comprises a program including an "initialization", a "read" and a "knit" subprogram. Shown in FIG. 8 is a flow diagram for the "read" subprogram illustrating the previously described operations of the circuits 53 and 55. The portion of the flow of FIG. 8 defined by the references D1 and D2 is shown more in detail in FIG. 9 for illustrating the circuit operations pertaining to the input device including the switch 43. The descriptions of the other subprograms are omitted in the accompanying drawings as outside the scope of the present invention.

In order to facilitate discrimination by the computer means of whether or not the scanning member 4 is actually positioned in its original starting position at the start of a scan, the linear encorder 28 is provided with a further slit 28*n* formed horizontally and longer than any of the other slits 28*p* or 28*f*. The slit 28*n* is disposed to be detected by the pulse generator 38 when the scanning member 4 beings a scan from the original starting position, while the linear encoder 28 has a reflective surface in regard to the right stroke end of the scanning member 4. At the start of a scan, the computer means discriminates that the scanner 4 is not positioned in the original starting position if the output of the pulse generator 38 (or more particularly, the output of the analog comparator therein) is a high level or logical "1". In such case, the scanner 4 is actuated to return to the original leftmost position. The stored program also contains means to control the circuitry to detect if the scanner 4 has been caused to stop due, for example, to trouble (e.g. binding) during a scan. This is achieved with a timer counter for determining the time interval between two successive strobe pulses provided by the pulse generator 38. If the time interval reaches or exceeds a predetermined length of time, the computer means discriminates that trouble has arisen in the reading device 3, whereupon the scanner 4 is actuated to return to the original starting position.

What is claimed is:

1. A device for providing signals representative of an instruction for control of a knitting machine, comprising:

a support member mounted on the knitting machine, a manually operable shiftable member supported on the support member for shifting movement between two positions, electromagnetic means energizable to shift the shiftable member from one to the other of said positions or vice versa, a drive circuit for energization of the electromagnetic means, and a switch disposed to be responsive to the position of the shiftable member to provide a corresponding output signal.

2. A device as claimed in claim 1 wherein the electromagnetic means is mounted on the shiftable member, and further comprising an element disposed on the support member for cooperation with the electromagnetic means to shift the shiftable member.

3. A device as claimed in claim 1 wherein the electromagnetic means is mounted on the support member, and the shiftable member includes an element cooperative with the electromagnetic means to shift the shiftable member.

4. A device as claimed in claim 3 wherein said element on the shiftable member comprises a permanent magnet.

5. A device as claimed in claim 4, wherein said switch comprises means responsive to a magnetic field for actuating said switch and is disposed to be operable by said permanent magnet on said shiftable member.

6. A device for providing electric signals representative of patterning instructions in a knitting machine having a support for supporting thereon a program carrier which carries thereon patterning instructions in rows and columns, an electrically controlled bidirectional incremental drive means for driving the support to feed the program carrier thereon in one or the other direction, and an electronic reading member disposed to read a row of patterning instructions on the program carrier, wherein the improvement comprises:

a switch means for providing an output signal for control of the drive means controlling the feeding direction of the program carrier on the support, a switch actuator adapted to be positioned in either of two positions, one operative and one inoperative for said switch, said switch actuator being manually shiftable between said two positions, and means for shifting the switch actuator between said two positions in response to readings by the reading member of a particular instruction mark on the program carrier.

7. The improvement as described in claim 6 wherein the program carrier includes a pair of columns corresponding to directions of feeding the program carrier on the support, particular marks in said columns being instructive of the feeding direction of the program carrier.

* * * * *